US009147335B2

(12) United States Patent
Raghunathan et al.

(10) Patent No.: US 9,147,335 B2
(45) Date of Patent: Sep. 29, 2015

(54) SYSTEM AND METHOD FOR GENERATING REAL-TIME ALERT NOTIFICATIONS IN AN ASSET TRACKING SYSTEM

(71) Applicant: Omnitracs, LLC, San Diego, CA (US)

(72) Inventors: Sudarshan Raghunathan, San Diego, CA (US); Chung Hung Lee, San Diego, CA (US); James A. Sassen, San Diego, CA (US)

(73) Assignee: OMNITRACS, LLC, Dallas, TX (US)

( * ) Notice: Subject to any disclaimer, the term of this patent is extended or adjusted under 35 U.S.C. 154(b) by 24 days.

(21) Appl. No.: 13/718,798

(22) Filed: Dec. 18, 2012

(65) Prior Publication Data

US 2013/0162425 A1 Jun. 27, 2013

Related U.S. Application Data

(60) Provisional application No. 61/579,228, filed on Dec. 22, 2011.

(51) Int. Cl.

| | |
|---|---|
| ***G08B 23/00*** | (2006.01) |
| ***G08G 1/00*** | (2006.01) |
| *G08G 1/01* | (2006.01) |
| *G08G 1/0967* | (2006.01) |

(52) U.S. Cl.

CPC ..... *G08B 23/00* (2013.01); *G08G 1/0129* (2013.01); *G08G 1/207* (2013.01); *G08G 1/0112* (2013.01); *G08G 1/0133* (2013.01); *G08G 1/096716* (2013.01); *G08G 1/096741* (2013.01); *G08G 1/096775* (2013.01)

(58) Field of Classification Search

CPC ..... G08G 1/096716; G08G 1/096741; G08G 1/096775

USPC ..... 340/425.5, 517, 539.1, 539.11

See application file for complete search history.

(56) References Cited

U.S. PATENT DOCUMENTS

| | | | | |
|---|---|---|---|---|
| 5,400,246 | A * | 3/1995 | Wilson et al. | 700/17 |
| 6,064,970 | A | 5/2000 | McMillan et al. | |
| 7,783,507 | B2 | 8/2010 | Schick et al. | |
| 7,880,609 | B2 | 2/2011 | Viegers et al. | |
| 2002/0184178 | A1 | 12/2002 | Tasooji et al. | |

(Continued)

FOREIGN PATENT DOCUMENTS

| | | | |
|---|---|---|---|
| WO | 9505649 | A1 | 2/1995 |
| WO | 2004104968 | A1 | 12/2004 |

OTHER PUBLICATIONS

International Search Report and Written Opinion—PCT/US2012/071003—ISA/EPO—May 24, 2013.

(Continued)

*Primary Examiner* — Daryl Pope

(74) *Attorney, Agent, or Firm* — Arent Fox LLP

(57) ABSTRACT

A system and method for generating real-time alert notifications includes a database for receiving in real-time at least one event, a processing engine for analyzing the at least one event with respect to a plurality of stored events, the processing engine also for determining whether the at least one event meets a defined condition, if the at least one event meets the defined condition, determining a prescriptive action and forwarding the prescriptive action to a user.

22 Claims, 5 Drawing Sheets

(56) References Cited

U.S. PATENT DOCUMENTS

| | | | | |
|---|---|---|---|---|
| 2003/0114967 | A1* | 6/2003 | Good | 701/29 |
| 2004/0236596 | A1* | 11/2004 | Chowdhary et al. | 705/1 |
| 2007/0214258 | A1 | 9/2007 | Karrapanan et al. | |
| 2007/0260363 | A1* | 11/2007 | Miller | 701/2 |

OTHER PUBLICATIONS

PeopleNet's New Real-Time Paperless Driver/Vehicle Management Workflows Automate Performance Monitoring, Violation Management, Vehicle Inspection Reporting and CSA Compliance, Mar. 14, 2011.

* cited by examiner

SYSTEM AND METHOD FOR GENERATING REAL-TIME ALERT NOTIFICATIONS IN AN ASSET TRACKING SYSTEM

CLAIM OF PRIORITY UNDER 35 U.S.C. §119

The present Application for Patent claims priority to Provisional Application No. 61/579,228 entitled "systems and methods for "SYSTEM AND METHOD FOR GENERATING REAL-TIME ALERT NOTIFICATIONS IN AN ASSET TRACKING SYSTEM", filed Dec. 22, 2011, and assigned to the assignee hereof and hereby expressly incorporated by reference herein.

DESCRIPTION OF THE RELATED ART

Systems for tracking, managing and maintaining a fleet of portable assets generally includes one or more systems for monitoring the location of the portable asset and one or more systems for monitoring various performance parameters of the portable asset and the individuals responsible for the portable asset. A system for monitoring the location of the portable asset may include a radio transceiver, a global positioning system (GPS) device, a terrestrial-based communication system such as a cellular network, or another type of communication device capable of periodically or continuously reporting its geographic location and other metrics relating to the portable asset to a receiving device. A system for monitoring the performance of the portable asset may include a number of sensors that collect and report vehicle performance data and a user interface for monitoring operator interaction with the portable asset.

In asset tracking systems, large volumes of real-time data pertinent to vehicle/asset location, vehicle/driver performance, and other data are continuously generated by devices located on the portable asset and uploaded to a back-end host system for processing and interpretation. The events and observations associated with this data can be related to several areas such as safety, compliance, fuel consumption, location efficiency/workflow, etc.

While this information can be correlated for viewing and consumption, a key challenge is to ensure that a user of the asset tracking system is presented with information that is most relevant to them at any particular instant. Relevant information can be considered that information which allows the user to take some action in response to the information. There is currently no effective way to provide timely, relevant notifications/action recommendations based on detected conditions (e.g., based on real-time events/observations) that require immediate attention by fleet owners. At present, a user of such a system often has to manually interpret these conditions and take the appropriate corrective action. Given the volume of incoming data and potential correlation between different kinds of events, this is an extremely difficult task. In an asset tracking application, it is desirable to be able to automatically review and analyze events and provide recommendations in real-time based on the analysis.

In the past, tracking and location systems have addressed a small portion of these issues, primarily related to predictive performance/user recommendations in a non real-time basis. Typically, existing systems interpret and pass events in real-time to dispatch systems. However, these systems do not interpret these events, nor do they add context based on cross-fleet information that is collected centrally.

SUMMARY

In an embodiment, a system for generating real-time alert notifications includes a database for receiving in real-time at least one event, a processing engine for analyzing the at least one event with respect to a plurality of stored events, the processing engine also for determining whether the at least one event meets a defined condition. If the at least one event meets the defined condition, the system determines a prescriptive action and forwards the prescriptive action to a user. Other systems and methods are also provided.

BRIEF DESCRIPTION OF THE DRAWINGS

In the figures, like reference numerals refer to like parts throughout the various views unless otherwise indicated. For reference numerals with letter character designations such as "102*a*" or "102*b*", the letter character designations may differentiate two like parts or elements present in the same figure. Letter character designations for reference numerals may be omitted when it is intended that a reference numeral encompass all parts having the same reference numeral in all figures.

DETAILED DESCRIPTION

The word "exemplary" is used herein to mean "serving as an example, instance, or illustration." Any aspect described herein as "exemplary" is not necessarily to be construed as preferred or advantageous over other aspects.

In this description, the term "application" may also include files having executable content, such as: object code, scripts, byte code, markup language files, and patches. In addition, an "application" referred to herein, may also include files that are not executable in nature, such as documents that may need to be opened or other data files that need to be accessed.

The term "content" may also include files having executable content, such as: object code, scripts, byte code, markup language files, and patches. In addition, "content" referred to herein, may also include files that are not executable in nature, such as documents that may need to be opened or other data files that need to be accessed.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

Figure 1:
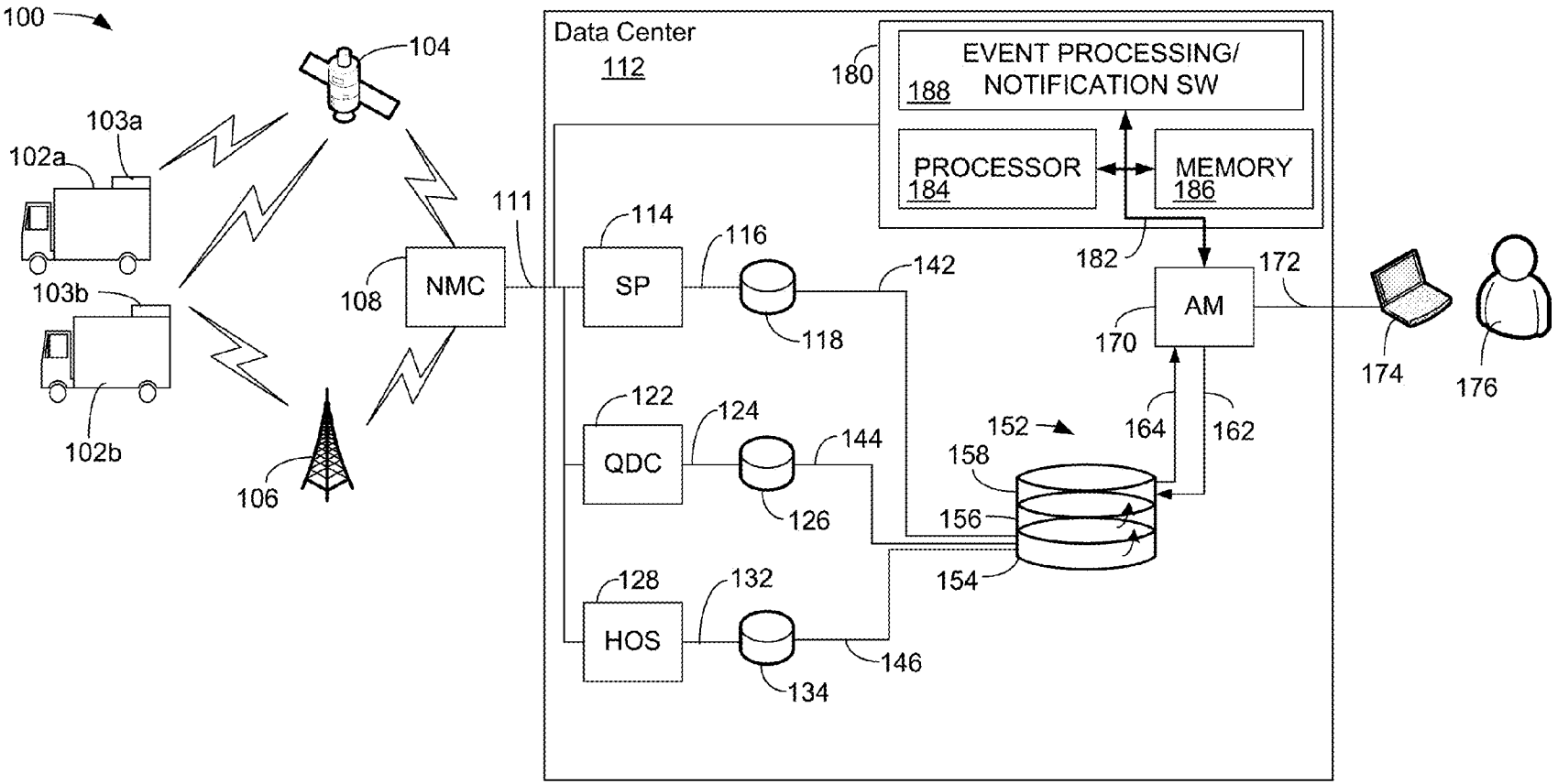
FIG. 1 is a functional block diagram illustrating exemplary elements of a system for generating real-time alert notifications.

FIG. 1 is a functional block diagram illustrating exemplary elements of a system for generating real-time alert notifications in an asset tracking system. In an embodiment, the system 100 includes fleets of vehicles, each fleet having at least one vehicle. However, typically, a fleet could include many tens, hundreds or thousands of vehicles. An example fleet is illustrated as having vehicles 102*a* and 102*b*. Additional fleets (not shown) are contemplated, but not shown. Each vehicle 102 is capable of bi-directional communication using, for example, a bi-directional communications module 103. The bi-directional communications module 103 may include, for example, the capability for satellite communication, terrestrial communication, radio frequency (RF) communication and other communication methodologies. As an example only, each vehicle 102 is in bi-directional communication with a network management center (NMC) 108 over at least one communication channel. In the example shown in FIG. 1, each vehicle 102 is in bi-directional communication with the NMC 108 over a satellite-based communication system 104 and a terrestrial-based communication system 106. A satellite communication system 104 and a terrestrial-based communication system 106 are known to those skilled in the art. Depending on many factors, data may be exchanged with the vehicles 102 using any combination of the satellite-based communication system 104 and the terrestrial-based communication system 106. In an embodiment, many different types of data are collected and transferred from the vehicles 102 to the NMC 108 and from the NMC 108 to the vehicles 102. Examples of such data include, but are not limited to, driver performance data, driver duty status, truck performance data, driver performance data, critical events, messaging and position data, location delivery data, and many other types of data. All of the information that is communicated to and from the vehicles 102 is processed via the NMC 108. The NMC 108 can be thought of as a data clearinghouse that receives all data that is transmitted to and received from the vehicles 102.

The system 100 also includes a data center 112. The data center 112 illustrates one possible implementation of a central repository for all of the data received from each of the vehicles 102 across all of the fleets. As an example, as mentioned above, many different types of data are transmitted from the vehicles 102 to the NMC 108 and from the NMC 108 to the vehicles 102. All of this data is transmitted via connection 111 to and from the data center 112. The connection 111 may comprise any wired or wireless dedicated connection, a broadband connection, or any other communication channel configured to transport the data.

In an illustrative embodiment, the data center 112 comprises a number of application servers and data stores. Details of the operation of the application servers and data stores are omitted as they are known to those skilled in the art. Although not specifically mentioned, each application server and data store includes a processor, memory including volatile and non-volatile memory, operational software, a communication bus, an input/output mechanism, and other operational systems as known in the art.

For example only, a first application server is referred to as a services portal (SP) server 114. The services portal server 114 receives, for example, messaging and positioning (M/P) data and/or location delivery efficiency (LDE) data and communicates this data over connection 116 to a data store 118. The data store 118 stores the M/P data and the LDE data.

Another application server is referred to as the quick deployment center (QDC) server 122. The quick deployment center server 122 receives, for example, critical event (CE) data from each of the vehicles 102. This data is transmitted over connection 124 and stored in a data store 126.

Another application server is referred to as the hours of service (HOS) server 128. The HOS server 128 receives data related to, for example, duty status (DS) data such as the number of hours that a driver operates a vehicle 102. This data is transferred over connection 132 and stored in the data store 134. Importantly, each of the data stores 118, 126 and 134 receive real-time disparate data from the NMC 108. The term "disparate" refers to the nature of the different types of data. This real-time disparate data is communicated to a data warehouse 152. The data store 118 communicates with the data warehouse over connection 142, the data store 126 communicates with the data warehouse 152 over connection 144 and the data store 134 communicates with the data warehouse 152 over connection 146. Importantly, each of the data transmitted over respective connections 142, 144 and 146 represent disparate data that is communicated to the data warehouse 152. It should be mentioned that although all servers are shown as residing in the data center 112, each of the servers 114, 122 and 128 may reside in other locations and be operatively coupled to the data store 152 in a distributed manner. Further, more or fewer servers may be associated with the data center 112.

In an embodiment, the data warehouse 152 is organized in a multiple-database structure. In the example shown herein, the data warehouse 152 is organized into three different databases. A first database is referred to as the "stage" 154, a second database 156 is referred to as the "operational data store (ODS)", and a third database 158 is referred to as a "data mart." Additional details of the organization of the data warehouse 152 will be described below. Further, other data structure organization models, such as, for example, a data grid, or another data storage model can be used. Importantly, it is the availability of the large amount of data collected over a large number of vehicles and a large number of fleets, over a long period of time that forms a historical database that is germane to the system for generating real-time alert notifications. The period of time may vary in duration, but is assumed to be sufficiently long so as to enable the collection of a history of data.

The data warehouse 152 communicates with an application referred to herein as an "analytics manager" 170. In an embodiment, the analytics manager 170 communicates with the data mart 158 over connections 162 and 164 and implements a set of routines that process the historical data in the data 158 mart to provide real-time event notifications. The real-time event notifications can be considered to be "proactive" in that the data in the data mart 158 can be analyzed to determine a set of conditions, which, if met, can be used to formulate a proactive alert notification that can be forwarded to a driver, a dispatcher, a third party, or another entity via the NMC 108. As an example, data relating to a subject driver's performance (e.g., number of hours on duty, lane departure events, etc.) and a history of all driver events in the vicinity of the subject driver can be analyzed and a proactive notification sent to the subject driver warning the subject driver to raise their awareness in that vicinity. The collected data can be evaluated and used to develop an evaluation of the risk to the subject driver and generate an appropriate alert notification. Among other factors, weather patterns, a history of incidents at particular locations, incidents related to a particular vehicle design, and other data can be correlated with the subject driver data and used to develop the alert notification. In addition to the subject driver, historical data across an entire industry can be used to develop trends that can be used to perform the above-described evaluation and analysis.

The analytics manager 170 captures and provides this data in a usable format over connection 172 for display on a terminal device 174. In an embodiment, the analytics manager 170 is an analysis engine and is associated with an execution system 180 over a system bus 182. In an embodiment, the execution system 180 includes a processor 184, a memory 186 and an event processing/notification software 188. The memory 186 can store the routines that are associated with the event processing/notification software 188, which are executed by the processor 184. In an embodiment, the event processing/notification software 188 is implemented using computer code that is written in a software programming language and that forms a complex event processing engine. In an embodiment, the processor 184 can execute the stored routines to implement the functionality of the analytics manager 170 and the event processing/notification software 188 that are described herein. Although shown as residing within the data center 112, the execution system 180 may reside elsewhere, and indeed may be implemented as a distributed system in which the memory 186, the processor 184 and the event processing/notification software 188 are located in different places. The terminal device 174 can be a user interface portal, a web-based interface, a personal computer (PC), a laptop, a personal data assistant (PDA), a dedicated terminal, a dumb terminal, or any other device over which a user 176 can interact with and view the display provided by the terminal device 174.

Figure 2:
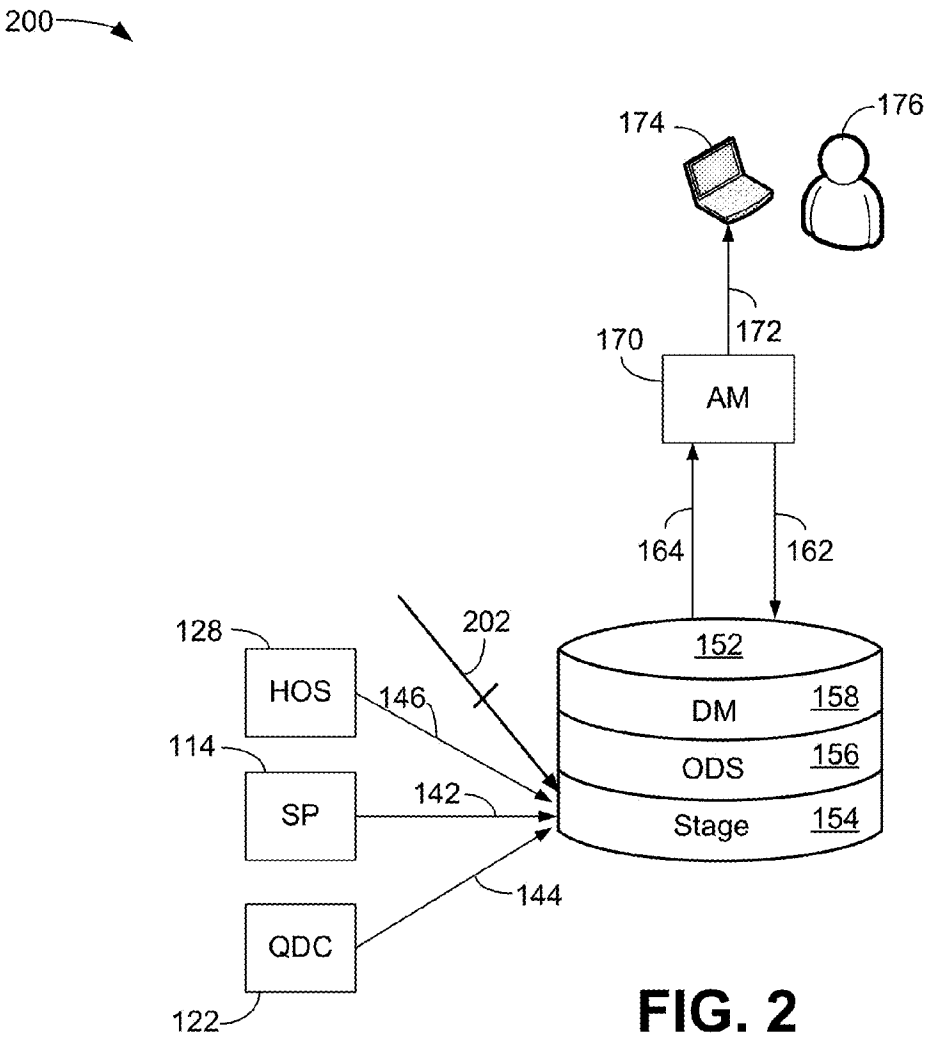
FIG. 2 is a schematic diagram illustrating in additional detail of the system for generating real-time alert notifications of FIG. 1.

FIG. 2 is a schematic diagram illustrating in additional detail the organization of the data warehouse 152 of FIG. 1. As mentioned above, disparate data from the services portal server 114, quick deployment center server 122 and the hours of service server 128 are provided over respective connections 142, 144 and 146 to the stage 154. In addition, other real-time data are provided to the stage 154 over connection 202. The examples of data provided herein are exemplary only. It should be mentioned that any data relating to fleet performance, vehicle performance, driver performance, location delivery performance, fuel efficiency, weather, location-specific incidents, and a number of other fleet vehicle performance parameters are all communicated to the stage 154 in real-time. All of the data received is replicated and updated in real-time in the stage 154.

The data in the stage 154 is then operated on and organized into the operational data store 156 according to one or more scripts. As used herein, the term "script" refers to an instruction that provides information on how to organize and format data. As an example, a script provided by the operational data store 156 to the stage 154 is used to organize the data in the stage 154 into a format that is used in the operational data store 156. The disparate data in the stage 154 is organized into a particular organized data structure in the ODS 156. As an example, the organized data structure in the ODS 156 may be one that associates the disparate data with a predefined parameter, such as a particular driver, vehicle, event, etc.

An example of a script that loads critical event (CE) data from the stage 154 to the ODS 156 follows. As an example, six (6) critical event data entries (e.g., hard braking, stability, lane departure, manual, lane departure disable, following time violation) are identified in the stage 154. A vehicle is then identified in the ODS 156 using, for example, a unique identifier such as a unified address (UA) that is associated with each bi-directional communications module 103 (FIG. 1). Then, the driver corresponding to the identified CE data entries is located by examining, for example, the HOS data events ((driver ID, on-duty driving, off-duty driving)/SP driver login event). Data relating to the vehicle speed can also be located in the stage 154 and placed in the ODS 156 and associated with that driver/event.

Once data is organized in the ODS 156, the data mart 158 can provide a script that exposes relevant data in the ODS 156 and provides the data as a subset of the data in the ODS 156 in a further organized format in the data mart 158. An example of a script that loads critical event (CE) data from the ODS 156 to the data mart 158 follows. As an example, a subset of four (4) critical event data entries (hard braking, stability, lane departure, manual) are identified in the ODS 156 and placed into a fact table in the DM 158. Then, unique customer/vehicle/driver identification is used to identify the vehicles and drivers corresponding to the collected CE event data. The relevant CE event data are then loaded into the DM 158. Group and fleet metrics are computed by aggregating information from the fact table in the data mart 158. Industry level metrics are computed by aggregating information from event tables in the ODS 156.

Once relevant data is available in the data mart 158, and in accordance with an embodiment of the system and method for generating real-time alert notifications, the analytics manager 170 and the event processing/notification software 188 analyze the relevant data and provide one or more proactive alert notifications to an appropriate user role.

Figure 3:
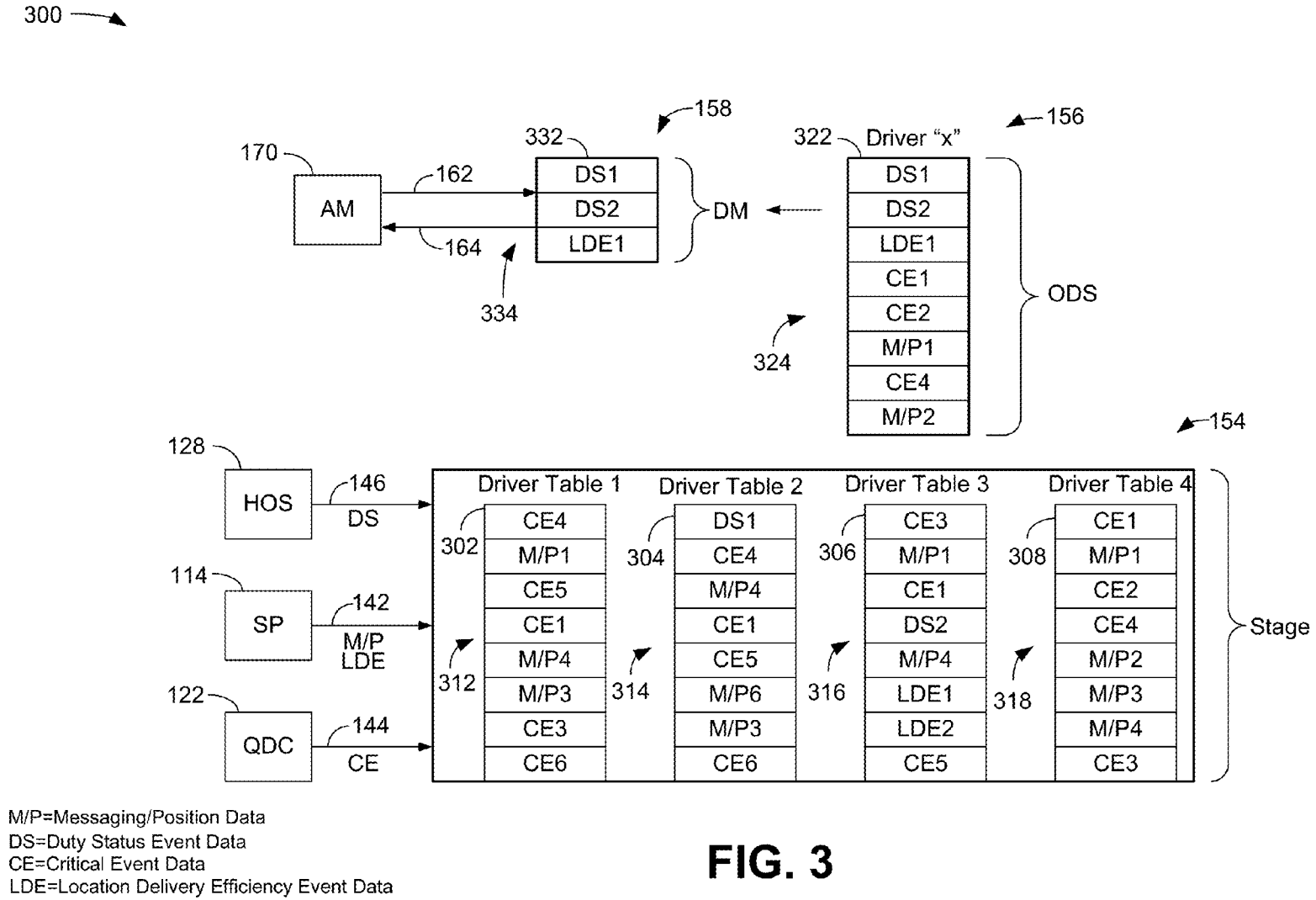
FIG. 3 is a graphical example showing an example of the organization of the data provided to the data warehouse of FIG. 2.

FIG. 3 is a graphical example 300 showing an example of the organization of the data provided to the data warehouse 152 of FIG. 2. As mentioned above, disparate data is provided from the SP server 114, the QDC server 122 and the HOS server 128 to the stage 154. For example purposes only, the stage 154 is illustrated in FIG. 3 as comprising four tables of driver data. The four driver tables 302, 304, 306 and 308 are illustrated for example purposes only, whereas the stage 154 may include many other tables having all of the disparate data. In addition to data relating to a particular vehicle 102 (FIG. 1) and a particular fleet, the data stored in the stage 154 represents all of the data available for a particular industry gathered over a period of time.

Each driver table 302, 304, 306 and 308 includes respective data entries 312, 314, 316 and 318. In the example shown, each data element in the data entries relates to one of the four types of data used in the example of FIG. 3. For example, in driver table 1, the entry "CE 4" refers to critical event data, and specifically refers to the fourth element of critical event data received by the stage 154. Each data element is numbered consecutively for ease of explanation. As an example, driver table 1 302 also includes a critical event (CE) data element "CE 1" as does each of the other driver tables 304, 306 and 308. The illustration of each data entry is meant to show the random and real-time nature of the way data is loaded into the stage 154.

An example script organizes the data in the stage 154 into the operational data store 156. The operational data store 156 is illustrated as including a driver table 322. However, the driver table 322 in this example refers to a particular driver, referred to as driver "x". All of the data contained in driver table 322 relates to a particular driver. Driver table 322 includes data entries 324. The data entries 324 are selected from the driver tables 302, 304, 306 and 308 according to an example script. In this instance, the script implemented by the ODS 156 pulls data events from those data entries 312, 314, 316 and 318 that relate to a particular driver, in this case driver "x", and places those data entries in the table 322. In this manner, the raw data in the stage 154 is now organized in the ODS 156 in a manner in which any data that pertains to, in this case, a particular subject driver is now shown and available to the data mart 158 in the table 322. In this example, this organizational structure allows data relating to the subject driver "x" in table 322 to be compared against and correlated with other drivers and other parameters so as to be able to compare a particular entity (in this case, subject driver "x") against the entire industry, fleet, or other entity. Historical data relating to any number of parameters can also be analyzed to determine whether the subject driver, driver "x" in this example, should be sent a proactive alert notification based on the analyzed data.

The data mart 158 includes a fact table 332 having data entries 334. The data entries 334, in particular, the selected data entries "DS1," "DS2," and "LDE1" are a subset of the data entries 324 in the table 322 in the ODS 156. The script implemented by the data mart 158 that loads data from the ODS 156 to the data mart 158 allows data optimization and a way of exposing relevant ODS data in the data mart 158 in an efficient way for querying and reporting. In this example, the entries 334 "DS1," "DS2," and "LDE1" are the relevant entries.

In an embodiment, the analytics manager 170 develops and sends its query over connection 162 to the data mart 158, so as to obtain the data entries 334, which are then provided over connection 164 to the analytics manager 170 to be displayed by the terminal device 174.

Figure 4:
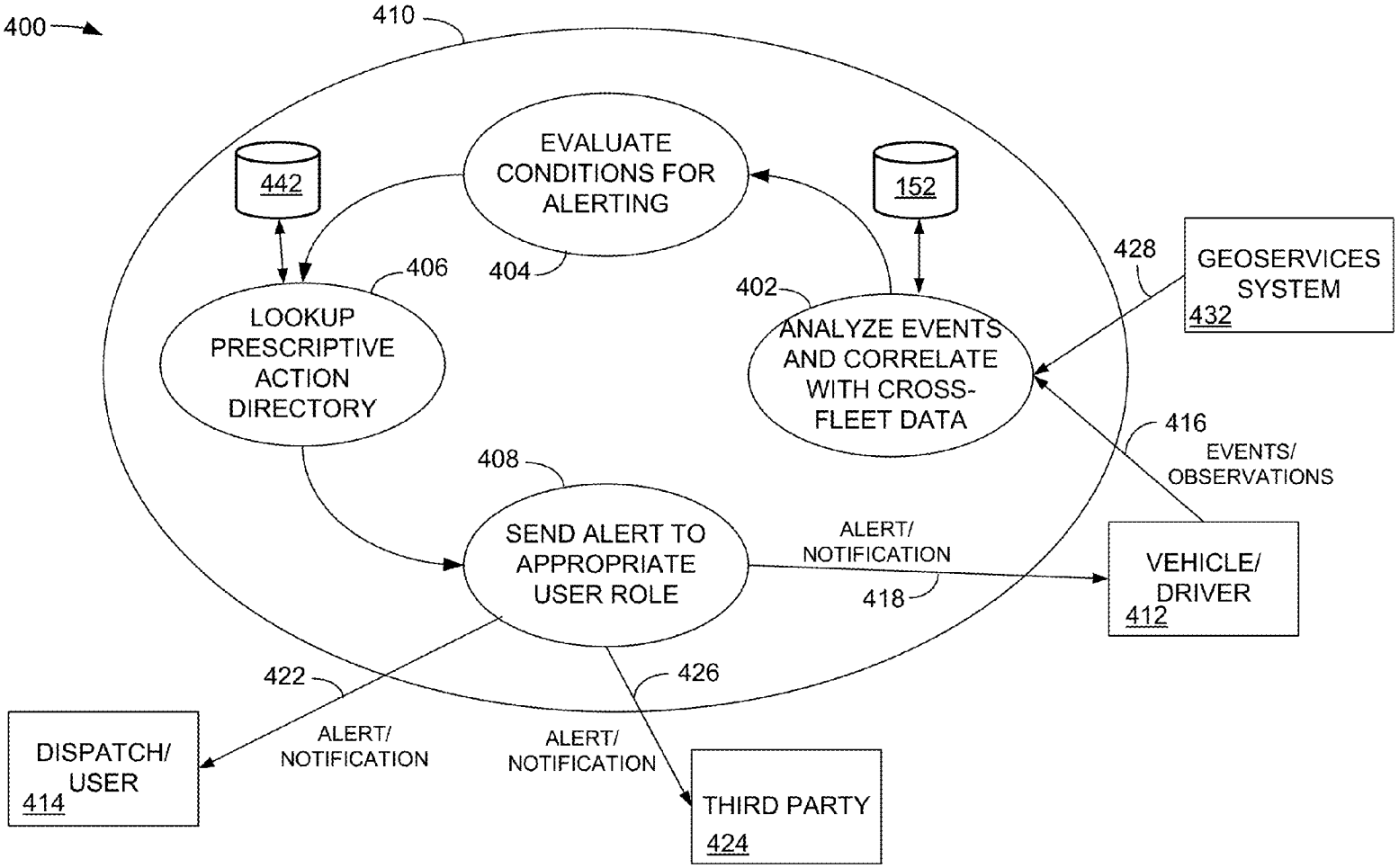
FIG. 4 is a block diagram illustrating an embodiment of the system and method for generating real-time alert notifications.

FIG. 4 is a block diagram illustrating an embodiment of the system and method for generating real-time alert notifications. The system 400 generates real-time proactive alert notifications and recommendations to different user roles based on evaluation of trigger events, observations and historical data. The system 400 can be described using a state diagram 410 illustrating the various states of the analysis and processing performed by the analytics manager 170 and the event processing/notification software 188 (FIG. 1). The system 400 tailors information based on user role/event context and provides proactive and real-time notifications/recommendations to all roles (including, for example, the dispatch role, the driver role, or a third party role). The system 400 is configured to trigger proactive, real-time notifications and/or recommendations to fleet owners, drivers, and other users of the system 400. This is done dynamically by automatically evaluating trigger events and observations based on user role/context. In addition, these events, observations and summarized analysis can also be relayed to third parties, such as insurance firms, navigation providers, etc. The system 400 provides interested third parties a consistent, dynamic and ongoing collection and correlation of data related to specific geographic locations during identified time periods. Data will typically be used by third parties for purposes of understanding issues, event likelihood or other matters related to locations or movement of vehicles between locations. In addition, the system 400 provides a single source having a consistent methodology for data collection and correlation. The system 400 eliminates the need for collecting and interpreting data across numerous sources with differing methods and algorithms.

The system 400 tracks, correlates and analyzes trigger event data with other contextual or role based data to identify critical, near-critical, or other conditions for alerting a user, driver, or other role. In addition, the system 400 maintains a directory of prescriptive actions based on event type (that can be configured by a user, such as a customer) which the system can refine over time. On detection of these conditions, the system 400 can then alert the appropriate audience (driver, driver manager, etc.) and also suggest prescriptive actions based on the analyzed conditions and a directory of prescriptive actions. The system 400 is based on the real-time aspect of event processing and alerting, and incorporates a historical collection of events to detect behavioral patterns and provide real-time prescriptive actions, also referred to as proactive notifications and alerts.

In an embodiment, in state 402, the system 400 receives events and observations 416 relating to a vehicle, a driver, or a combination of vehicle and driver. In state 402, the system uses the analytics manager 170 and the event processing/notification software 188 to analyze and evaluate the events/observations 416 as they flow through the system 400 by correlating the events/observations 416 with data relevant to the analysis to determine whether the analyzed events/observations 416 meet a defined condition. A defined condition may be one in which the events/observations 416 are considered to be such that an event notification is warranted. In each example, the relevant data is the data that pertains to the current analysis. In the example of safety data relating to a particular location, the relevant data can be data relating to the subject driver and parameters that currently or will soon likely affect the subject driver at the subject location. In the example of a driver approaching a historically dangerous intersection or area, the relevant data could be the history of accidents in that area, vehicle speed of vehicles involved in accidents in that area, driver time on duty, driver performance leading up to the moment in time that the driver is approaching the dangerous area, etc. Other analysis will use other data, depending on the desired analysis. For example, if it is desired to analyze load delivery performance, data relating to time of delivery, duration of delivery, driver efficiency for delivery, and other data relevant to load delivery can be analyzed. The relevant data is analyzed across all fleet data available in the data warehouse 152. The data warehouse 152 (FIG. 2) makes all of this data available for analysis by the analytics manager 170 and the execution system 180.

In state 404, and based on event type, different event conditions can be evaluated to determine whether to provide an alert or notification. The rules for evaluation can be predetermined or can be user-configurable. The rules for each analysis are provided by the event processing/notification SW 188 (FIG. 1) via the analytics manager 170 (FIG. 1). In an embodiment, the event processing/notification software 188 forms a complex event processing engine and includes logic for applying business rules to the data to obtain the desired analysis in real-time. In alternative embodiments, a user interface, which can be part of the analytics manager 170, can be used to apply business rules to the data on a real-time, on-going basis and can be used to have a user-configurable system for analyzing the data and providing the appropriate alert notification. On the basis of the evaluation performed in state 404, the system 400 can determine if there is an urgent/timely alert or notification, which would be sent at state 408. The alert/notification could be sent to the vehicle or driver 412 as an event notification 418; to the dispatch or user role 414 as an event notification 422, or to a third party 424 as an alert notification 426. Details on what the alert should entail, the audience for the alert, and the medium for the alert will be user configurable. The system 400 can determine the most relevant audience for the alerts and send the alert using a back-end dispatch system or directly over-the-air to the driver/vehicle 412 or other entity.

In state 406, the system 400 maintains and accesses a directory 442 of prescriptive actions associated with different event types and trigger conditions. The directory 442 is accessible to the analytics manager 170 and, in an embodiment, can be maintained in or as part of the memory 186 located in the execution system 180. At state 406, the system 400 determines if there are recommended actions that can be taken based on the alert condition, and if so, at state 408 forwards these recommended actions to the correct entity.

A prescriptive action can be directed to a particular user of the system, such as a driver, a dispatcher and a third party. The prescriptive action can be based on a geographic location, on an analysis of the stored events, on a subject vehicle, on a subject driver, or on other events. Although not shown in FIG. 1, in addition to being in bi-directional communication with the vehicle or driver 412, the NMC 108 is also in bi-directional communication with a dispatch/user 414 and a third party 424.

The recommended actions taken from the directory 442 of prescriptive actions could be maintained by the fleet owner and can be associated with specific event types. The system 400 can then lookup the recommended actions from the directory 442 based on events/observations 416 and, if applicable, user-defined thresholds, to determine the correct or appropriate prescriptive action. Further, the system 400 can track the impact of these recommended actions over time and provide feedback to fleet owners allowing them to adjust the prescriptive action directory as needed.

In addition to relaying these events and conditions to the various fleet roles (e.g., dispatch, driver, etc.), this information can also be provided anonymously and selectively sent to third parties through an integration service (not shown).

The data warehouse 152 maintains all safety related events across fleets (such as hard braking, roll stability, etc.). Based on this accumulated information, the system 400 can determine "dangerous" intersections, accident prone zones, etc. The system 400 can then define these zones as transient landmarks. When a vehicle enters these zones (e.g., as detected by a geoservices arrival event 428 from a geoservices system 432), the system 400 can automatically trigger a notification 418 to the driver 412 of the vehicle and provide safe driving recommendations; correlating safety events with driver fatigue conditions, or detecting patterns of safety events for a group or fleet and notify drivers entering a safety zones accordingly. The system 400 can interpret the event and then add context.

For example, if a specific zone has a severe weather alert, the system 400 can proactively notify drivers who are close to the zone and provide a recommendation on how to modify driver behavior (e.g., slow down when going down a grade or stop and check brakes).

Since the data warehouse 152 maintains a record of individual driver performance and correlates safety events to driver duty cycles (current version correlates safety events to time of day), it could determine periods where the driver is most prone to commit a safety violation and potentially trigger a prescriptive notification to suggest rest, etc.

Figure 5:
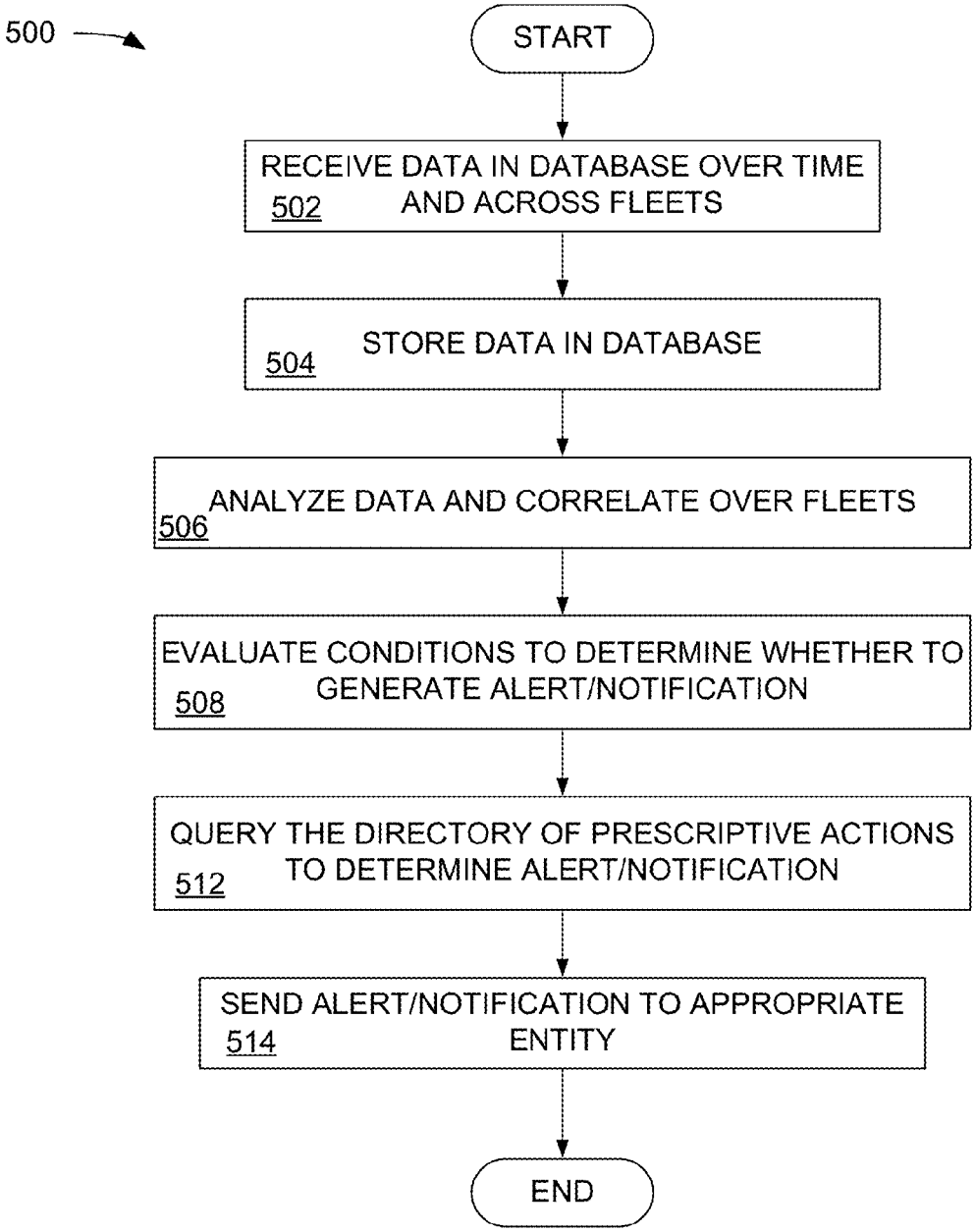
FIG. 5 is a flowchart illustrating an example of a method for generating real-time alert notifications.

FIG. 5 is a flowchart 500 illustrating an example of a method for generating real-time alert notifications. The blocks in the flowchart can be performed in or out of the order shown, and in certain embodiments, can be performed in parallel. In block 502 data is received in real-time in the data warehouse 152. The data pertains to driver performance data, driver duty status, truck performance data, driver performance data, critical events, messaging and position data, location delivery data, and many other types of data. The data can be collected and stored over a period of time to generate a database having historical trends.

In block 504, the data is stored in the data warehouse 152.

In block 506, the analytics manager 170 and the event processing/notification software 188 analyze and evaluate the events/observations 416 as they flow through the system 400 by correlating the events/observations 416 with data relevant to the analysis. The data is analyzed across all fleet data available in the data warehouse 152.

In block 508, and based on event type, different event conditions are evaluated to determine whether to provide an alert or notification.

In block 512, the directory 442 of prescriptive actions associated with different event types and trigger conditions is queried to determine an appropriate event/notification based on the analysis performed in blocks 506 and 508.

In block 514, on the basis of the analysis, correlation and evaluation performed in blocks 506 and 508, an urgent/timely alert or notification is sent.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention, as defined by the following claims.

What is claimed is:

1. A system for generating real-time alert notifications, comprising:

a database for receiving in real-time at least one event; and a processing engine for analyzing the at least one event with respect to a plurality of stored events, the processing engine being further for:

determining whether the at least one event meets a defined condition;

if the at least one event meets the defined condition, selecting a prescriptive action from a directory of prescriptive actions, and generating in real-time a proactive alert notification with the prescriptive action for a user, wherein the prescriptive action is tailored based on a user role and contextual data related to the at least one event; and forwarding the prescriptive action to the user.

2. The system of claim 1, wherein the at least one event relates to vehicle performance or driver performance in an asset tracking system.

3. The system of claim 1, wherein the user is selected from a driver, a dispatcher and a third party.

4. The system of claim 1, wherein the prescriptive action is based on a geographic location.

5. The system of claim 1, wherein the plurality of stored events are collected over a period of time.

6. The system of claim 5, wherein the prescriptive action is based on an analysis of the plurality of stored events and a subject vehicle.

7. The system of claim 5, wherein the prescriptive action is based on an analysis of the plurality of stored events and a subject driver.

8. A method for providing real-time alert notifications, comprising:

receiving in real-time at least one event;

analyzing the at least one event with respect to a plurality of stored events;

determining whether the at least one event meets a defined condition;

if the at least one event meets the defined condition, selecting a prescriptive action from a directory of prescriptive actions, and generating in real-time a proactive alert notification with the prescriptive action for a user, wherein the prescriptive action is tailored based on a user role and contextual data related to the at least one event; and forwarding the prescriptive action to the user.

9. The method of claim 8, wherein the at least one event relates to vehicle performance or driver performance in an asset tracking system.

10. The method of claim 8, wherein the user is selected from a driver, a dispatcher and a third party.

11. The method of claim 8, wherein the prescriptive action is based on a geographic location.

12. The method of claim 8, wherein the plurality of stored events are collected over a period of time.

13. The method of claim 12, wherein the prescriptive action is based on an analysis of the plurality of stored events and a subject vehicle.

14. The method of claim 12, wherein the prescriptive action is based on an analysis of the plurality of stored events and a subject driver.

15. The method of claim 8, wherein the prescriptive action is selected based on the at least one event.

16. The method of claim 8, wherein the user is a driver of a vehicle, and wherein the proactive alert notification is sent to the driver while operating the vehicle.

17. A system for generating real-time alert notifications in an asset tracking application, comprising:

a database for receiving in real-time at least one event related to an asset tracking application; and a processing engine for analyzing the at least one event with respect to a plurality of stored events, the plurality of stored events relating to asset tracking, the processing engine being further for:

determining whether the at least one event meets a defined condition;

if the at least one event meets the defined condition, selecting a prescriptive action from a directory of prescriptive actions, and generating in real-time a proactive alert notification with the prescriptive action for a user, wherein the prescriptive action is tailored based on a user role and contextual data related to the at least one event; and forwarding the prescriptive action to the user.

18. The system of claim 17, wherein the at least one event relates to vehicle performance or driver performance.

19. The system of claim 17, wherein the user is selected from a driver, a dispatcher and a third party.

20. The system of claim 17, wherein the prescriptive action is based on a geographic location.

21. The system of claim 17, wherein the plurality of stored events are collected over a period of time.

22. The system of claim 21, wherein the prescriptive action is based on an analysis of the plurality of stored events and a subject vehicle.

* * * * *